US010633175B2

(12) United States Patent
Looker

(10) Patent No.: US 10,633,175 B2
(45) Date of Patent: Apr. 28, 2020

(54) AIR CARGO CONTAINER WITH CABLE TENSIONED DOOR

(71) Applicant: Satco, Inc., El Segundo, CA (US)

(72) Inventor: Peter Looker, El Segundo, CA (US)

(73) Assignee: SATCO, INC., El Segundo, CA (US)

( * ) Notice: Subject to any disclaimer, the term of this patent is extended or adjusted under 35 U.S.C. 154(b) by 1125 days.

(21) Appl. No.: 14/949,064

(22) Filed: Nov. 23, 2015

(65) Prior Publication Data

US 2017/0144832 A1 May 25, 2017

(51) Int. Cl.
*B65D 90/00* (2006.01)
*B65D 88/14* (2006.01)
*B65D 90/02* (2019.01)

(52) U.S. Cl.
CPC ..... *B65D 90/008* (2013.01); *B65D 88/14* (2013.01); *B65D 90/021* (2013.01)

(58) Field of Classification Search
CPC ..... B65D 90/008; B65D 90/0089; B65D 90/021; B65D 88/14; B65D 88/52; B65D 88/125; B60P 7/0823
See application file for complete search history.

(56) References Cited

U.S. PATENT DOCUMENTS 3,961,585 A * 6/1976 Brewer ..... B60P 7/0876 410/97
4,046,186 A 9/1977 Nordstrom
4,429,730 A 2/1984 Elston
4,436,466 A * 3/1984 Marino ..... B61D 45/001 410/118
4,538,663 A 9/1985 Looker
RE34,892 E 4/1995 Dunwoodie
5,601,201 A 2/1997 Looker
5,667,002 A 9/1997 Neustadt
6,625,926 B1 * 9/2003 Mancini ..... A01G 17/04 47/32.5
7,063,227 B2 6/2006 Looker
2003/0047561 A1 * 3/2003 Neto ..... B65D 90/046 220/1.6
2015/0107440 A1 * 4/2015 Bedson ..... G10D 13/023 84/413

FOREIGN PATENT DOCUMENTS

EP 0127936 A1 12/1984

OTHER PUBLICATIONS

European Patent Office, "Extended European Search Report" issued in EP Application No. 16198390.3-1708 dated Feb. 20, 2017.

* cited by examiner

*Primary Examiner* — Anthony D Stashick
*Assistant Examiner* — Blaine G Neway
(74) *Attorney, Agent, or Firm* — Perkins Coie LLP

(57) ABSTRACT

A cargo container includes a base, side walls and a rear wall on the base and a top attached to the side walls and the rear wall. A door frame is attached to the base, the side walls and the top. A fabric panel is provided on or in the door frame. Left and right cable rings are provided at left and right lower corners of the fabric panel. Left and right door posts are positioned at left and right lower corners of the door frame. A cable in or on the fabric panel is attached to or extends around the left and right cable rings. A cable tensioner tensions the cable to secure the fabric panel in closed position in the door frame.

12 Claims, 7 Drawing Sheets

AIR CARGO CONTAINER WITH CABLE TENSIONED DOOR

BACKGROUND OF THE INVENTION

Air cargo containers have been used for the transportation of cargo by aircraft for many years. Cargo such as cartons, smaller shipping containers, etc. is first loaded into containers. The containers are then loaded into an aircraft. Use of air cargo containers is faster than loading cargo directly into the cargo space of the aircraft, since the individual cartons need not be separately placed and secured within the aircraft. The air cargo containers can also be loaded at locations remote from the airport. Furthermore, because the cargo containers are typically designed to fit the interior dimensions of specific aircraft, the containers fit more securely in the cargo space and do not shift during flight. These and other advantages of air cargo containers have made air cargo containers widely used in the air freight and airline industry.

A typical air cargo container includes a base such as a flat square or rectangular aluminum pallet. Many air cargo containers have fabric door which may be rolled up or pulled to one side for loading and unloading the container. The fabric door is closed and secured with straps or other fittings, or via a rigid metal door bar at the bottom of the fabric door latched onto the base of the container.

While these designs have performed well in the past, they may have several drawbacks. Initially, securing the door using straps and fittings may take a relatively long time, even under optimal conditions. Adverse conditions, such as rain, snow, extreme cold, wind, and darkness, make securing the door even more difficult and time consuming. In addition, some door designs have limited ability prevent inadvertent displacement of the door. Accordingly, an improved air cargo container is needed.

SUMMARY OF THE INVENTION

In one aspect, a cargo container includes a base, side walls and a rear wall on the base and a top attached to the side walls and the rear wall. A door frame is attached to the base, the side walls and the top. A fabric panel is provided on or in the door frame. Left and right cable rings are provided at left and right lower corners of the fabric panel. Left and right door posts are positioned at left and right lower corners of the door frame. A cable in or on the fabric panel is attached to or extends around the left and right cable rings. A cable tensioner tensions the cable to secure the fabric panel in closed position in the door frame.

In another aspect, a door for a cargo container has a square or rectangular fabric panel, with a left cable ring at a lower left corner of the fabric panel, and with a right cable ring at a lower right corner of the fabric panel. A first cable in or on the fabric panel has first and second end loops, with the first end loop of the first cable on the right cable ring, extending up from the right cable ring to an upper right corner of the fabric panel, then across a top of the fabric panel, then diagonally down and across the fabric panel, with the first cable extending around the right cable ring, and with the second end loop of the first cable on the left cable ring. A second cable on or in the fabric panel is positioned in a mirror image of the first panel. When used in a cargo container having a tensioner, the door provides a secure closure which is quick and simple to operate.

DETAILED DESCRIPTION OF THE DRAWINGS

Figure 1:
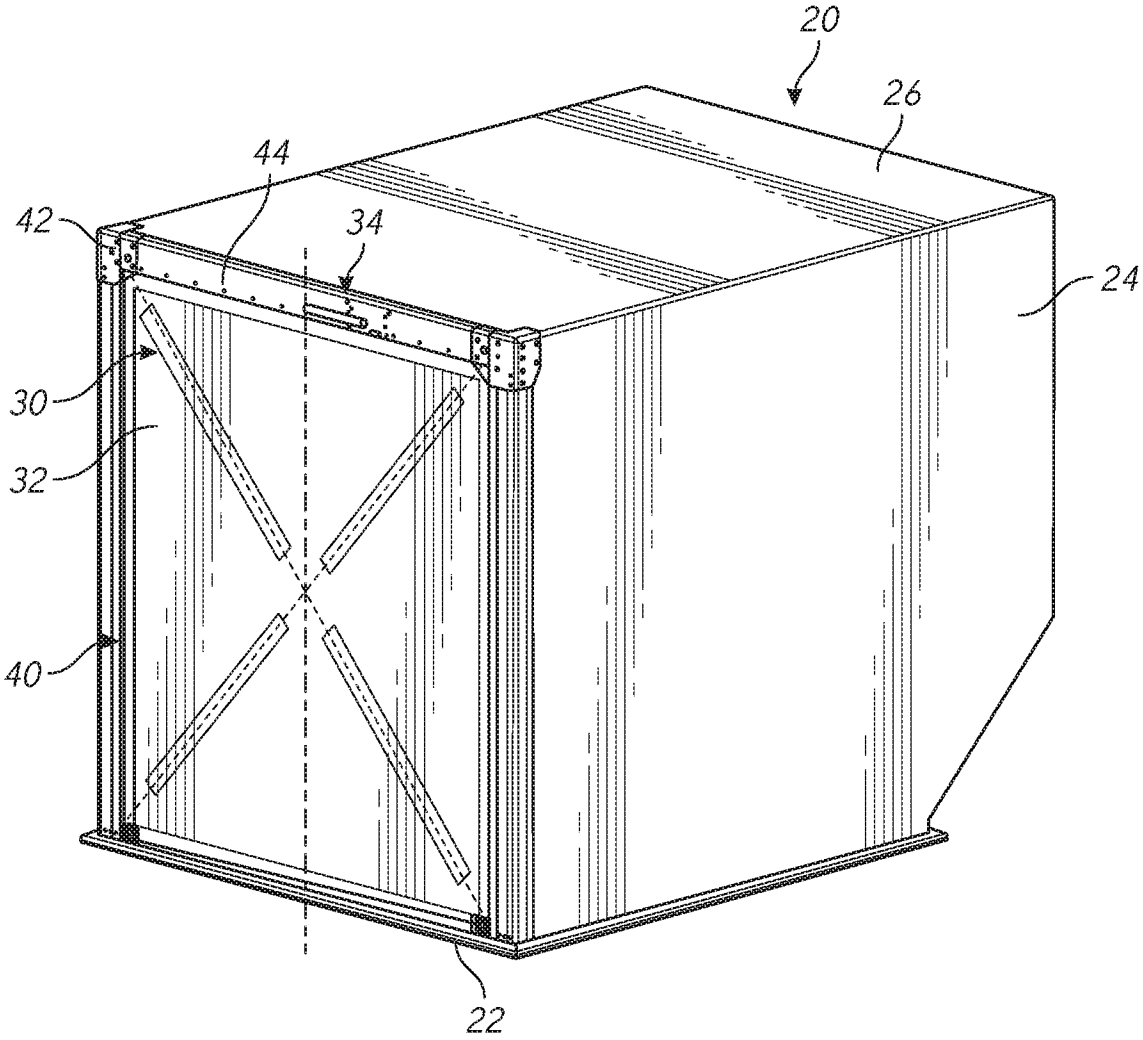
FIG. 1 is a perspective view of a new air cargo container.

As shown in FIG. 1, a container 20, such as an air cargo container, has a floor 22, left and right side walls 24, a top 26 and a rear wall. The rear wall is attached to the left and right side walls 24 and the rear wall and left and right side walls are attached to the floor 22. The top 26 is attached to the left and right side walls 23 and to the rear wall, to provide a five sided enclosure having a front opening within a door frame 40. The door frame 40 may include a header beam 44 attached to corner brackets 42.

Figure 2:
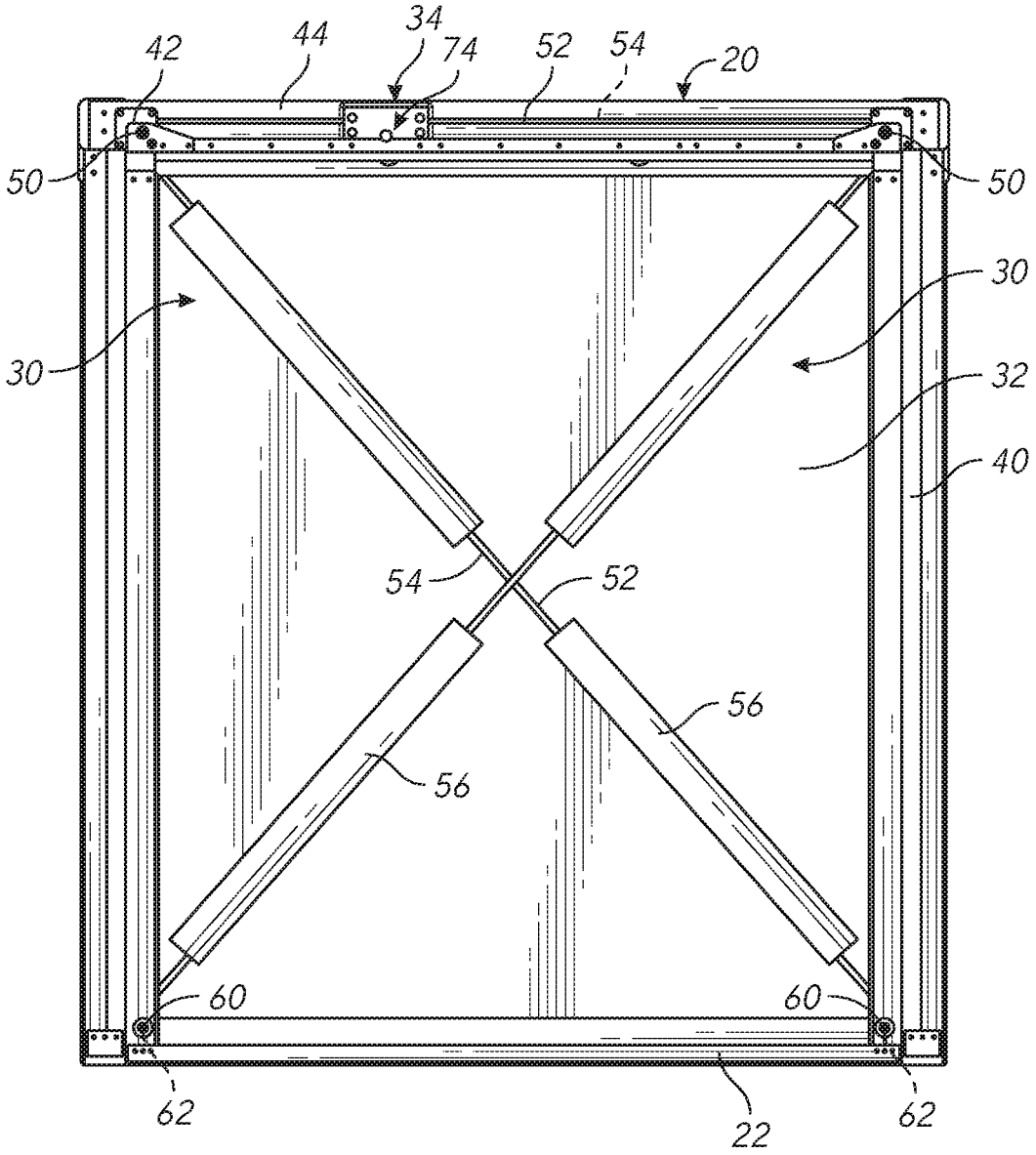
FIG. 2 is a view of the door of the container of FIG. 1, from inside the container.

A door assembly 30 of the container 20 includes a fabric panel 32 which can be rolled, folded or pushed up to provide access into the container 20. FIG. 2 is a view from within the container 20 looking forward to the door frame 40, with the door assembly 30 in a closed position covering the opening through the door frame 40. Cable guides or pulleys 50 are provided at the upper left and right interior corners of the container 20, either on the corner brackets 42 or on the header beam 44. In the example shown, each cable guide can accommodate two cables.

Figure 5:
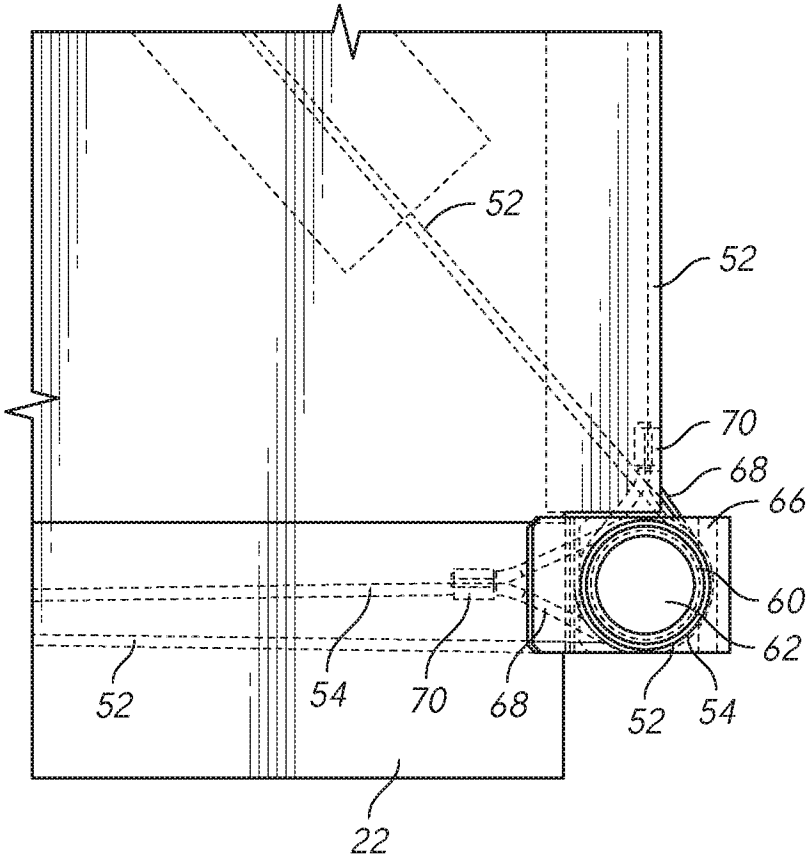
FIG. 5 is an enlarged detail view of the door post as shown it is shown in FIG. 2.
Figure 4:
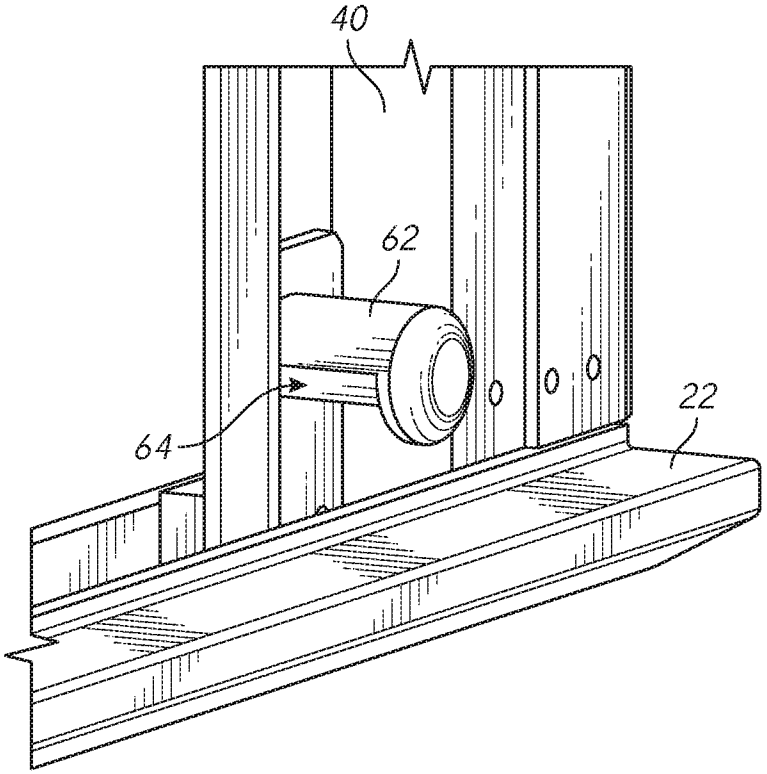
FIG. 4 is a perspective view of the door post at the lower front right corner of the container shown in FIGS. 1-3.

Referring momentarily to FIG. 4, door posts 62 extend forward from the lower left and right corners of the door frame 40. Each door post 62 may be tubular or cylindrical and may have a down facing undercut or recess 64, and optionally a rounded or front end. As shown in FIG. 5, left and right door rings 60 are provided with, or part of, the fabric panel 32, with the door rings 60 located at the lower left and right corners of the fabric panel 32. Each door ring 60 may be provided with typically two or three cable grooves around the outside diameter of the door ring 60, depending on the number and routing of the cables used. Each door ring 60 may optionally be attached to a mounting plate 66 which in turn is attached to the fabric panel 32, e.g., by stitching or adhesives. Alternatively, the door rings 60 may be relatively loosely positioned within an opening in the fabric panel without using any mounting plate 66, and without the door rings positively attached to the fabric panel, so that nominally forces on the door rings 60 are carried largely entirely by the cables and not by the fabric panel. The inside diameter of the door ring 60 (e.g., 4 to 10 cm) is slightly larger (e.g. 1-5 mm) than the diameter of the door post 62.

The rigid components of the container including the floor 22, the side walls 24, the top 26, the header beam 44, the corner brackets 42 and the door frame 40 are typically made of metal, such as aluminum. Alternatively, one or more of these elements may be a composite, synthetic or plastic material. The door posts 62 may also be provided from aluminum tubes or rods. The fabric panel 32 is generally a high strength synthetic sheet material, such as Nylon, although any flexible material may be used. The top edge of the fabric panel 32 is permanently attached at the top of the door frame or to the header beam. The door rings 60 may be aluminum or a plastic material.

Figure 9:
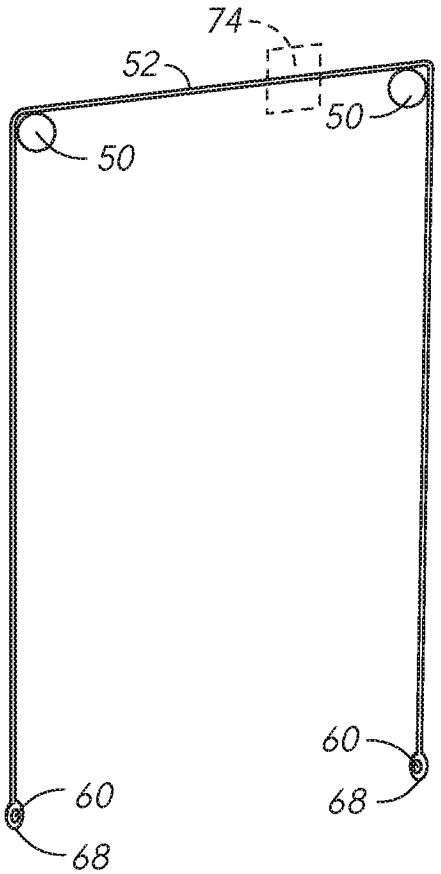
FIG. 9 is a diagram separately showing the first cable of the container shown in FIGS. 1-5.

In the example shown in the drawings, the container 20 operates with two cables 52 and 54. As shown in FIGS. 2, 5 and 9, a first cable 52 has a first end loop 68 around the right door ring 60. The first end loop 68 is captive on the right door ring 60 but need not be rigidly attached to the right door ring 60. As shown in FIG. 9, from the first end loop 68 the first cable 62 extends up along the right edge of the fabric pane 32, around the right cable guide 50, across the top of the door frame 40, and around the left cable guide 50. The first cable 52 then extends down along the right edge of the fabric panel 32 and terminates via a second looped end 68 of the first cable 52 on the left door ring 60, in the same way that the first looped end 68 is captive on the right door ring 60.

Figure 10:
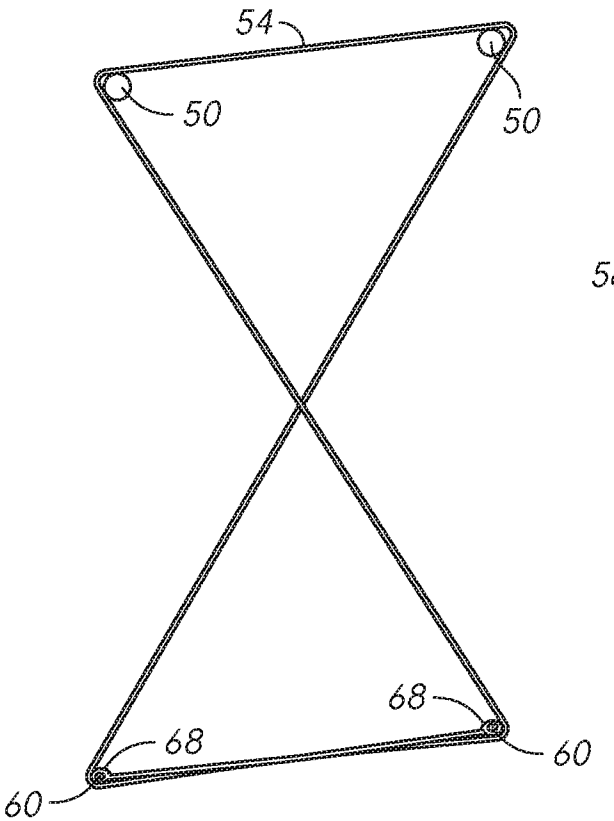
FIG. 10 is a diagram separately showing the second cable of the container shown in FIGS. 1-5.

Referring to FIG. 10, a second cable 54 has a first end loop 68 around the right door ring 60. The first end loop 68 of the second cable 54 is captive on the right door ring 60 but need not be rigidly attached to the right door ring 60. From the first end loop 68, the second cable 54 extends laterally across the lower edge of the fabric panel 32; wraps around the left door ring 60; runs diagonally up and across the fabric panel 32; around the right cable guide 50; across the top of the door frame 40 and around the left cable guide 50; runs diagonally down and across the fabric panel 32, wraps around the right door ring 60 and terminates via a second looped end 68 of the second cable 54 on the left door ring 60, in the same way that the first looped end 68 is captive on the right door ring 60. The second cable forms symmetrical lower and upper triangles and has two segments extending along a lower edge of the fabric panel.

Figure 11:
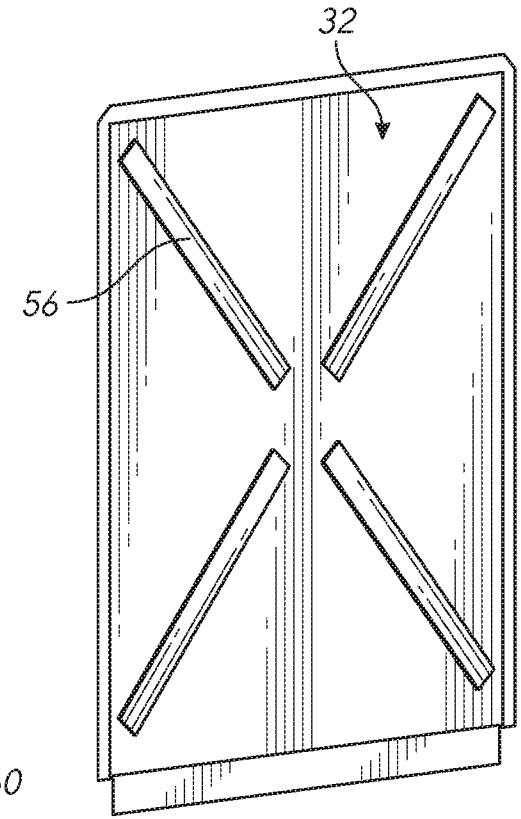
FIG. 11 is a diagram showing the first and second cables overlaid onto a fabric panel.

With the cables 52 and 54 in FIGS. 9 and 10 overlaid onto the fabric panel shown in FIG. 11, in this embodiment, the left edge and the right edge of the fabric panel is each supported by a single cable, the bottom edge of the fabric panel is supported by two cables, and the tensioner 74 described below operates on two cables.

The looped ends 68 may be formed using cable clamps 70. The fabric panel 32 may also be replaced with a mesh or netting material. In an alternative design, the door rings 60 may be omitted with the cable looped ends 68 placed on the door posts.

As shown in FIG. 2, the cables 52 and 54 may be routed through or under cable covers 56 on the back surface of the fabric panel 32, and they may also be routed through cable covers or fabric panel loops at the left and right edges of the fabric panel 32.

Figure 6:
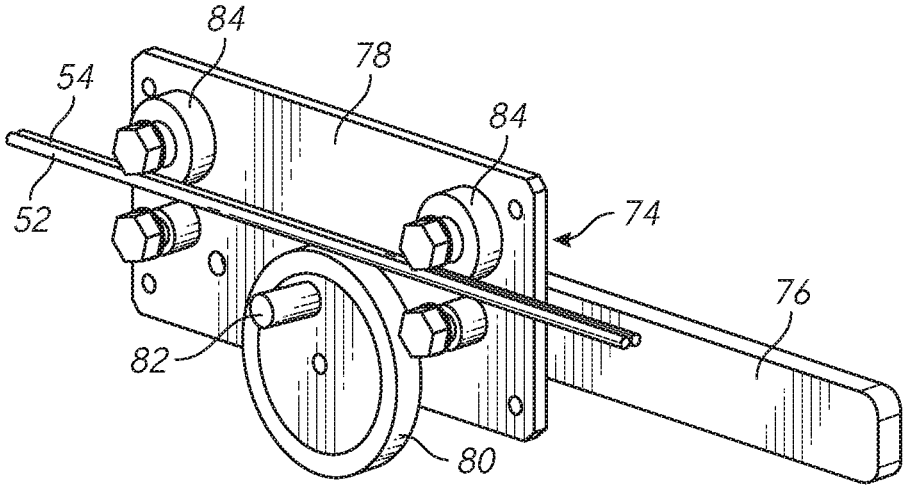
FIG. 6 is a rear perspective view of the cable tensioner shown in FIG. 2, with the cable tensioner shown in the released position.
Figure 7:
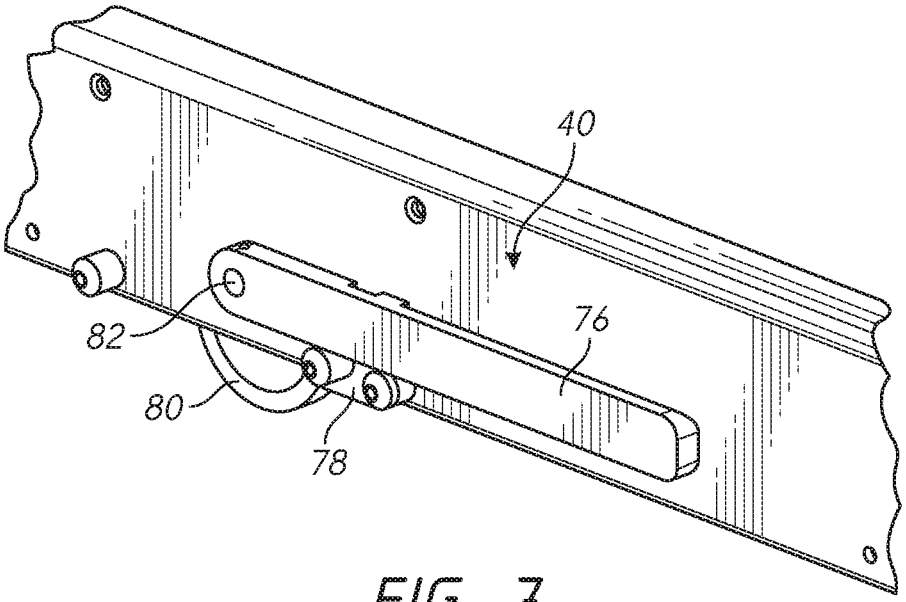
FIG. 7 is an enlarged front perspective view of the cable tensioner shown in FIG. 6.
Figure 8:
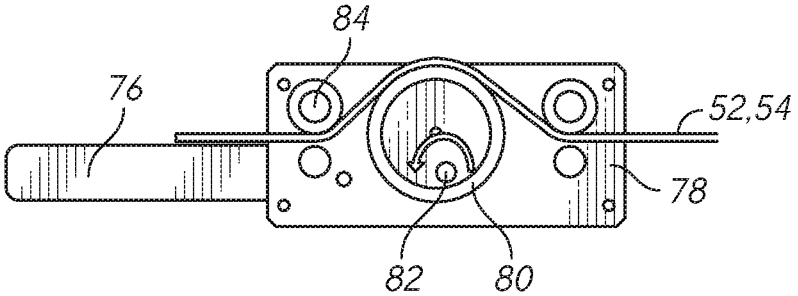
FIG. 8 is a rear view of the cable tensioner shown in FIG. 6, with the cable tensioner shown in the tensioned position.

Turning to FIGS. 6-8, a tensioner 74 may be located on the header beam 44. Any form of tensioner that can apply and release tension on the cables 52 and 54 may be used. In the example shown the tensioner 74 includes idlers 84 rotatably attached to a lever plate 78 on the header beam 44. A cam wheel 80 is attached to an eccentric axle 82 attached to a lever 76. As is apparent by overlaying the first and second cables 52 and 54 in FIGS. 9 and 10, both cables extend across the header beam 42 and both cables 52 and 54 pass through the tensioner 74.

FIG. 6 shows the tensioner 74 in the released position, with the cables 52 and 54 extending largely straight through the tensioner 74. With the tensioner 74 in the released position the cables 52 and 54 are slack, allowing each door ring 60 to be pulled into alignment with, and fitted onto, the door posts 62. To move the tensioner 74 into the tensioned position, the lever 76 is rotated through one half turn. This moves the cam wheel 80 up deflecting the first and second cables 52 and 54 into the position shown in FIG. 8, applying tension to the cables. As a result, the door rings 60 are effectively locked onto the door posts 62, securing the fabric panel 32 tightly into position over the door frame 40.

The tensioned cables may also be positioned to hold the sides and bottom edge of the fabric panel 32 in place against the door frame 40 providing a secure closure of the container, and also providing a weather seal. With the cables 52 and 54 tensioned, the door rings 60 are pulled into the undercut 64. The door rings 60 are consequently held onto the door posts 62 even against e.g. an impact of cargo against the fabric panel at either lower front corner of the container.

As shown in FIG. 8, in the tensioned position the axle 82 is moved past the center of the cam wheel 80 so that the reaction force of the cables on the cam wheel 80 tends to hold the tensioner 74 into the tensioned position. A lug 78 on the header beam 44 may act as a hard stop for the handle 76, as well as allowing for a security or inspection tag to be attached to or through the handle 76.

Figure 3:
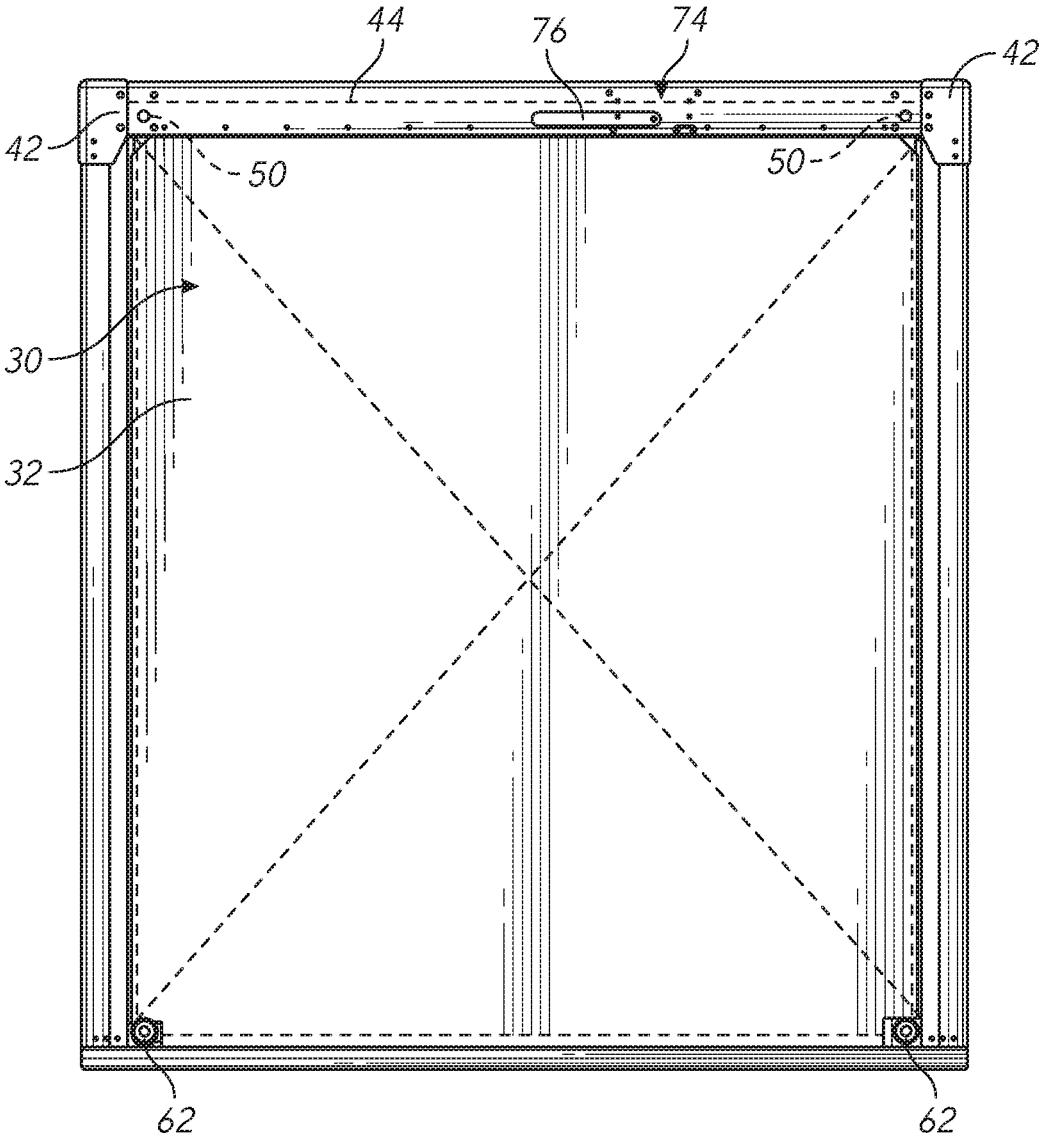
FIG. 3 is a front view of the container shown in FIGS. 1 and 2.

With the lever 76 rotated back to the released position, as shown in FIG. 3, tension on the cables 52 and 54 is released. The door rings 60 can then be freely pulled forward off of the door posts 62. The fabric panel 32 is then rolled or folded up and latched or tied to the head beam, or placed on top of the container 20, during loading and unloading.

In the example shown, the cables extend through the tensioner 74 at all times, regardless of whether the door is open or closed. However, alternative designs may be used where the cables are looped over or into the tensioner 74 only when the door is closed and before tensioning the cables. In these alternative designs, the tensioner 74 may be located anywhere on the door frame. Of course, other forms of tensioners may be used, including tensioners using levers, springs, actuators or other elements in place of the eccentric cam wheel 80. Separate tensioners may also be used for separate cables. As shown in FIG. 1, the lever 76 may be positioned to one side of the lateral centerline of the container, so that two containers may be positioned door frame to door frame, with no gap between them.

Figure 12:
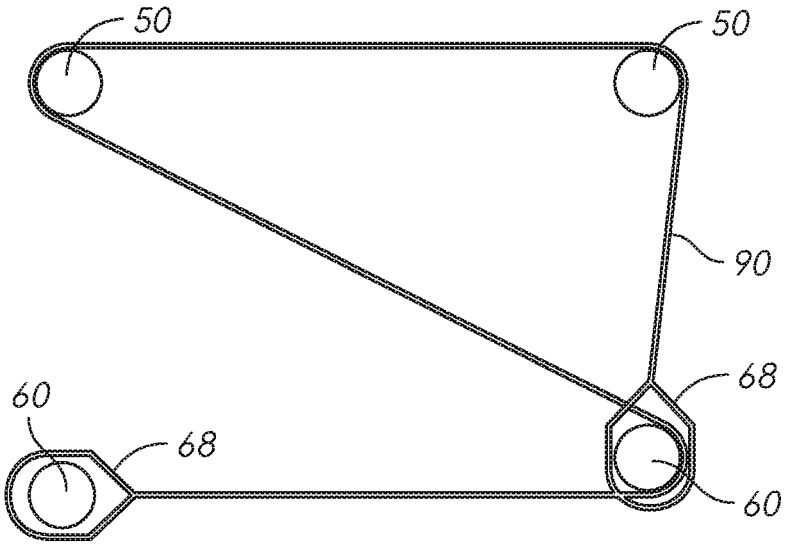
FIG. 12 is a diagram showing alternative first cable design, with the second cable a mirror image of the first cable.
Figure 13:
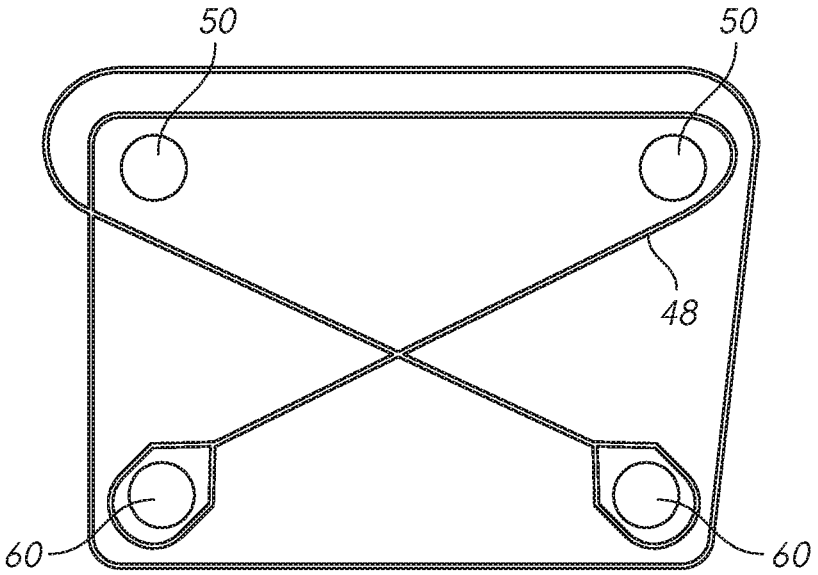
FIG. 13 is a diagram showing an alternative design using a single cable.

As shown in FIG. 12, an alternative design using two cables has a first cable 90 having a first end loop 68 around the right door ring 60. From the first end loop 68 the first cable 90 extends up along the right edge of the fabric pane 32, around the right cable guide 50, across the top of the door frame 40, and around the left cable guide 50. The first cable 90 then extends down across the fabric panel 32, wraps around the first door ring 60 and terminates via a second looped end 68 of the first cable 90 on the left door ring 60, in the same way that the first looped end 68 is captive on the right door ring 60. In this alternative design, the second cable 54 is a mirror image of the first cable 90. The container 20 may also be designed with a single cable, as shown in FIG. 13. Of course, other numbers of cables and other cable arrangements may also be used.

Unlike various existing cargo containers, the present cargo container does not require a door bar at the bottom edge of the door. Consequently, the weight of the door bar and related hardware is eliminated.

A method for securing a door of a cargo container includes positioning a flexible, folding or fabric panel in a door frame of the cargo container. A first cable ring at a lower right corner of the panel is placed onto a first post at a lower right corner of the door frame. A second cable ring at a lower left corner of the panel is placed onto a second post at a lower left corner of the door frame. A cable attached to or passing around the rings is then tensioned, to prevent the cable rings from moving off of the posts.

Thus, a novel cargo container has been shown and described. Various changes and modifications may of course be made without departing from the spirit and scope of the invention. The invention, therefore, should not be limited except by the following claims and their equivalents.

The invention claimed is:

1. A cargo container, comprising:

a base, side walls and a rear wall on the base and a top attached to the side walls and the rear wall;

a door frame attached to the base, the side walls and the top;

a flexible panel on or in the door frame;

a left cable ring at a lower left corner of the flexible panel;

a right cable ring at a lower right corner of the flexible panel;

a left cable post at a lower left corner of the door frame;

a right cable post at a lower right corner of the door frame;

a cable tensioner;

a first cable and a second cable, with the first cable extending from the left cable ring up along a left edge of the flexible panel, across an upper end of the flexible panel, and down along the right edge of the flexible panel to the right cable ring;

with the second cable crossing over itself at a central position on the flexible panel; and with the cable tensioner movable to apply tension on both the first and second cables.

2. The air cargo container of claim 1 with the first cable having a first end loop on the left cable ring, and the first cable extending around left and right upper cable guides at upper left and right corners of the door frame, and the first cable having a second end loop on the right cable ring, and with the second cable having a first end loop on the right cable ring, the second cable extending laterally across a lower end of the flexible panel, around the left cable ring, diagonally upward and around an upper right cable guide, laterally across an upper end of the flexible panel, around an upper left cable guide, diagonally downward and around the right cable ring, laterally back across the lower end of the flexible panel, with a second end loop of the second cable on the left cable ring, and with both the first and second cables extending through the cable tensioner.

3. The air cargo container of claim 1 with the door frame including a header beam, and with the cable tensioner on the header beam, and the air container having no door bar at the lower end of the flexible panel.

4. The air cargo container of claim 1 with the flexible panel foldable or collapsible vertically and horizontally.

5. The air cargo container of claim 3 with the cable tensioner including a lever at a front side of the header.

6. The air cargo container of claim 1 wherein the left and right cable rings are held onto the left and right cable posts, when the cable tensioner is in a tensioned position, and wherein the left and right cable rings are removable from the left and right cable posts, when the cable tensioner is in a released position, respectively.

7. The air cargo container of claim 6 with the left and right cable rings in openings in the flexible panel at left and right lower corners of the flexible panel.

8. The air cargo container of claim 7 with the left and right cable posts each comprising a cylinder having a down facing recess and a rounded front end.

9. A door for a cargo container, comprising:

a square or rectangular flexible panel;

a left cable ring at a lower left corner of the flexible panel;

a right cable ring at a lower right corner of the flexible panel;

a first cable in or on the flexible panel, with the first cable having first and second end loops, with the first end loop on the right cable ring, and the first cable extending up along a right edge of the flexible panel from the right cable ring, around right and left upper cable guides at upper right and left corners of the door frame, and down along a left edge of the flexible panel, and the first cable having a second end loop on the left cable ring; and a second cable in or on the flexible panel, with the second cable having first and second end loops around the right and left cable rings, respectively, and with the second cable crossing over itself.

10. The door of claim 9 with the second cable forming symmetrical lower and upper triangles.

11. The door of claim 10 with the second cable having two segments extending along a lower edge of the flexible panel.

12. A cargo container, comprising:

a base, side walls and a rear wall on the base and a top attached to the side walls and the rear wall;

a door frame attached to the base, the side walls and the top;

a flexible panel on or in the door frame;

a first cable extending from a lower left corner of the flexible panel up along a left edge of the flexible panel, across an upper end of the flexible panel, and down along a right edge of the flexible panel to a lower right corner of the flexible panel;

a second cable extending from the lower right corner of the flexible panel laterally across a lower end of the flexible panel to the lower left corner of the flexible panel, diagonally upward to an upper right corner of the flexible panel, laterally across an upper end of the flexible panel to an upper left corner of the flexible panel, diagonally downward to the lower right corner of the flexible panel, and laterally back across the lower end of the flexible panel;

the first and second cables extending through a cable tensioner and the cable tensioner movable to apply tension on both the first and second cables.

* * * * *